US006088509A

United States Patent [19]

Reznik

[11] Patent Number: 6,088,509

[45] Date of Patent: Jul. 11, 2000

[54] CONICAL SHAPED ELECTROLYTE ELECTRODE FOR ELECTROHEATING

[76] Inventor: David Reznik, 12690 Viscaino Rd., Los Altos Hills, Calif. 94022

[21] Appl. No.: 09/362,600

[22] Filed: Jul. 28, 1999

[51] Int. Cl.[7] ..... H05B 3/60

[52] U.S. Cl. ..... 392/320; 392/338; 392/314; 99/358; 426/244

[58] Field of Search ..... 392/320, 319, 392/314, 312, 338; 99/358, 451, 483; 426/244, 521, 614

[56] References Cited

U.S. PATENT DOCUMENTS

| | | | |
|---|---|---|---|
| 1,171,929 | 2/1916 | Cubitt | 392/338 |
| 4,739,140 | 4/1988 | Reznik . | |
| 5,583,960 | 12/1996 | Reznik . | |
| 5,636,317 | 6/1997 | Reznik . | |
| 5,863,580 | 1/1999 | Reznik . | |

FOREIGN PATENT DOCUMENTS

| | | | |
|---|---|---|---|
| 23213 | 6/1972 | Australia | 392/314 |
| 428580 | 5/1974 | U.S.S.R. | 392/338 |
| 1512510 | 10/1989 | U.S.S.R. | 426/244 |

*Primary Examiner*—John A. Jeffery
*Attorney, Agent, or Firm*—Darby & Darby

[57] ABSTRACT

Electroheating apparatus including a conduit, a cone-shaped electrode circumferentially surrounding the conduit, an electrical power source connected to the electrode, an electrically non-conductive endcap connected to the conduit and electrode, the conduit, electrode and endcap defining a chamber therebetween, and an electrolytic solution disposed in the chamber.

9 Claims, 1 Drawing Sheet

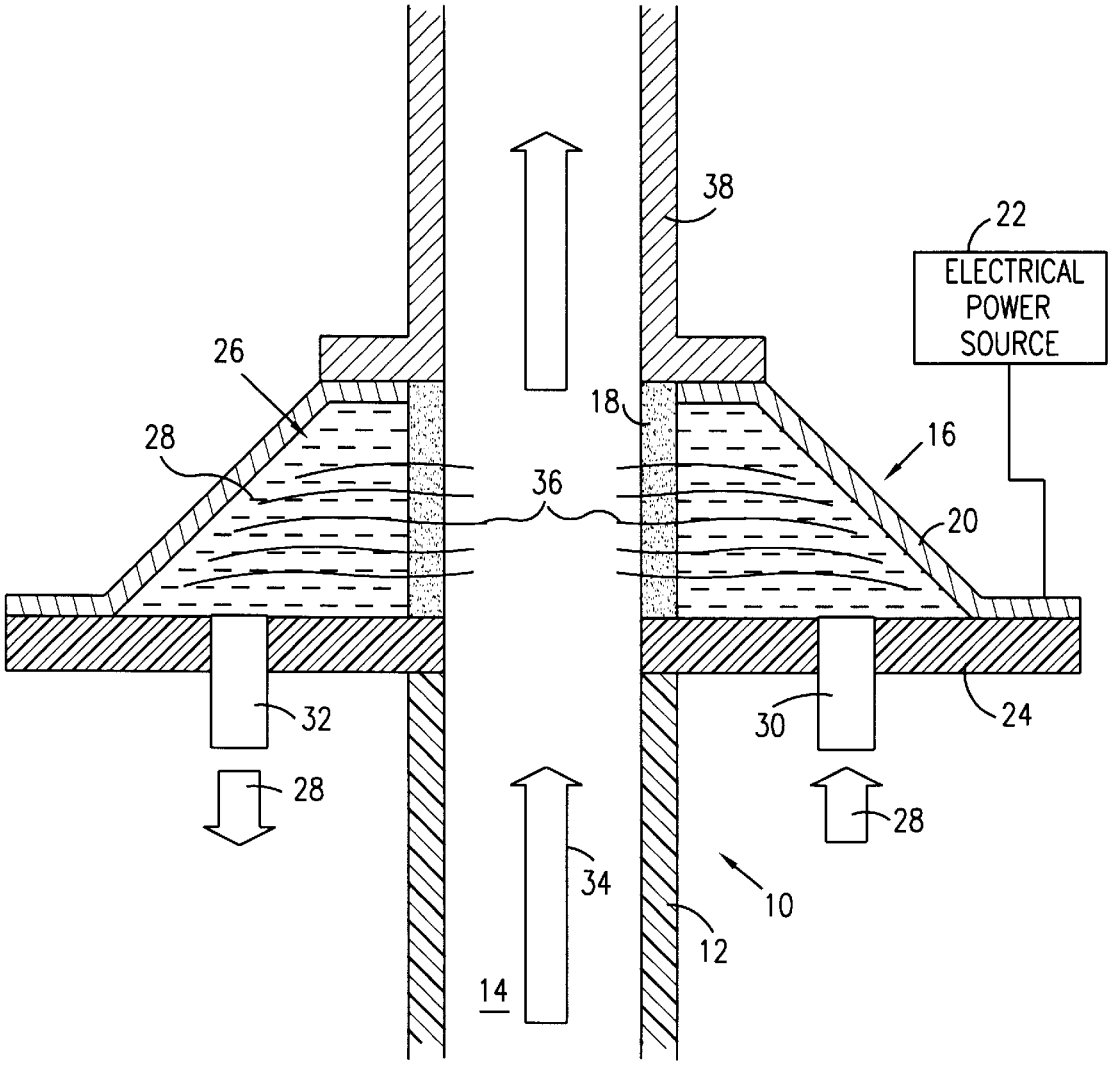
38
22
ELECTRICAL
POWER
SOURCE
26
18
28
16
36
20
32
30
24
28
28
34
10
12
14

CONICAL SHAPED ELECTROLYTE ELECTRODE FOR ELECTROHEATING

FIELD OF THE INVENTION

The present invention relates to generally to methods and apparatus for electroheating of foodstuffs and particularly to electroheating

BACKGROUND OF THE INVENTION

Electroheating is a method of rapidly heating substances, such as solid or liquid foodstuffs, by passing a current through the material, wherein the material acts as a resistive heater. Such rapid heating methods are disclosed in applicant/assignee's U.S. Pat. Nos. 4,739,140; 5,583,960; 5,636,317 and 5,863,580, the disclosures of which are incorporated herein by reference.

The fluid to be electroheated must be in contact with a large area of the electrode in order to prevent a high current density on the electrode that might lead to arcing. U.S. Pat. Nos. 5,583,960; 5,636,317 and 5,863,580 describe apparatus for increasing the electrode contacting area and thereby reducing the current density. The apparatus includes a narrow tube which terminates at both ends thereof in funnel-like cones. The electrode is the size of the large base of each cone.

A problem exists when attempting to electroheat semi-solid materials, such as coagulated proteins or dough. It is difficult to form good electrical contact between a flat electrode and the semi-solid material. The narrow tube apparatus of the abovementioned patents solves this problem by providing good contact area and low current density at the cone ends. However, although this arrangement provides low current density, it increases the dwell time in the electroheater, since the volume of the cones is much larger than that of the narrow tube. The increased dwell time presents another problem by making it difficult if not impossible to pass the semi-solid material through the electrode, since the semi-solid material tends to thicken and harden during the dwell time.

Another problem associated with electroheating of a biological fluid, is that the fluid contacts the electrode. The electrodes are usually made of graphite, which is preferable to metal because metal ions can dissolve in the contacting fluid, whereas graphite does not. Nevertheless, even with graphite electrodes, there is an electrolytic reaction with the fluid, and the fluid becomes reduced. Although in some cases this can be beneficial, such as in recovery of oxidized vitamin C in electroheated orange juice, nevertheless in many cases this is not desirable.

SUMMARY OF THE INVENTION

The present invention seeks to provide improved methods and apparatus for electroheating flowable materials, i.e., fluids or semi-solid materials, such as fluids with large particles, coagulated proteins or dough, which solve all of the abovementioned problems of the prior art.

The present invention employs as electrode which is not in direct contact with the flowable material which is to be heated. The electrode is generally conical in shape and defines a chamber which is also conical. The chamber is filled with an electrolytic solution which wets a porous, electrically non-conductive conduit through which the flowable material is passed. Electrical current passes from the electrode through the electrolytic solution to the conduit and into the flowable material, thereby electroheating the material.

Due to the conical shape of the electrode and chamber, the current is not concentrated at the upstream base of the chamber, but rather is distributed along the length of the conduit and the electrode, thereby ensuring a relatively low current density. Most preferably, the electrolytic solution is chosen to have an electrical conductivity such that, taking into consideration the electrical conductivity of the flowable material, there is generally an equal distribution of current through the flowable material along the entire length of the conduit. There is a short dwell time because the flowable material flows through a cylindrical conduit rather than through a cone. Thus the present invention solves both of the abovementioned problems of the prior art.

There is thus provided in accordance with a preferred embodiment of the present invention electroheating apparatus including a conduit, a cone-shaped electrode circumferentially surrounding the conduit, an electrical power source connected to the electrode, an electrically non-conductive endcap connected to the conduit and electrode, the conduit, electrode and endcap defining a chamber therebetween, and an electrolytic solution disposed in the chamber.

In accordance with a preferred embodiment of the present invention the conduit is constructed of a porous, electrically non-conductive material which is wetted by the electrolytic solution.

Further in accordance with a preferred embodiment of the present invention a tube is adapted for flow therethrough of a flowable material, the tube being in fluid communication with the conduit. Preferably the tube is constructed of an electrically non-conductive material.

Still further in accordance with a preferred embodiment of the present invention a flowable material flows through the conduit, wherein electrical current passes from the electrode through the electrolytic solution to the conduit to the flowable material, thereby electroheating the flowable material.

Additionally in accordance with a preferred embodiment of the present invention the electrolytic solution is chosen to have an electrical conductivity such that there is generally an equal distribution of electrical current through the flowable material along an entire length of the conduit.

Further in accordance with a preferred embodiment of the present invention an inlet pipe and an exit pipe are provided for flow therethrough of the electrolytic solution into and from the chamber.

Still further in accordance with a preferred embodiment of the present invention a cooling tube is positioned downstream of the conduit and in fluid communication therewith.

There is also provided in accordance with a preferred embodiment of the present invention a method for electroheating a flowable material, including providing electroheating apparatus including a conduit, a cone-shaped electrode circumferentially surrounding the conduit, an electrical power source connected to the electrode, an endcap connected to the conduit and electrode, the conduit, electrode and endcap defining a chamber therebetween, and an electrolytic solution disposed in the chamber, causing a flowable material to flow through the conduit, and passing an electrical current from the electrode through the electrolytic solution to the conduit to the flowable material, thereby electroheating the flowable material.

BRIEF DESCRIPTION OF THE DRAWINGS

The present invention will be understood and appreciated more fully from the following detailed description, taken in conjunction with the drawing in which: is illustrated of electroheating apparatus constructed and operative in accordance with a preferred embodiment of the present invention.

DETAILED DESCRIPTION OF PREFERRED EMBODIMENTS

Reference is now made to the single FIGURE electroheating apparatus 10 constructed and operative in accordance with a preferred embodiment of the present invention.

Electroheating apparatus 10 includes a tube 12 preferably made of an electrically non-conductive material, such as a plastic. Tube 12 is adapted for flow therethrough of a flowable material 14, i.e., fluid or semi-solid material, such as coagulated proteins or dough, and as such is provided with any required flow connectors (not shown), as is known in the art. Tube 12 is attached to a non-contact electrode device 16.

Non-contact electrode device 16 comprises a conduit 18, preferably constructed of a porous, electrically non-conductive material, such as ceramic. Circumferentially surrounding conduit 18 is a cone-shaped electrode 20. Electrode 20, preferably made of graphite, is connected to an electrical power source 22. An electrically non-conductive endcap 24 is preferably attached to the upstream faces of electrode 20 and conduit 18. It is appreciated that endcap 24 can be fashioned as an integral part of either conduit 18 or electrode 20. Electrode 20 conduit 18 and endcap 24 define a chamber 26 therebetween which is filled with an electrically conducting salt solution (herein referred to as an electrolytic solution) 28, such as an NaCl solution. Electrolytic solution 28 is preferably fed into chamber 26 via an inlet pipe 30 and exits therefrom via an exit pipe 32. Porous conduit 18 is kept wet by electrolytic solution 28.

In operation of electroheating apparatus 10, electrical current passes from electrode 20 through electrolytic solution 28 to conduit 18. Flowable material 14 is fed through tube 12 to conduit 18 generally in the direction of an arrow 34. Flowable material 14 contacts conduit 18 and the electrical current flows through material 14, thereby electroheating material 14. Paths of electrical current are generally shown by arcuate lines 36. Due to the conical shape of electrode 20 and chamber 26, the current is not concentrated at the upstream base of chamber 26, but rather is distributed along the entire length of conduit 18, thereby ensuring a relatively low current density. Most preferably, the electrolytic solution 28 is chosen to have an electrical conductivity such that, taking into consideration the electrical conductivity of the material 14, there is generally an equal distribution of current through material 14 along the entire length of conduit 18.

A cooling tube 38 is preferably positioned downstream of conduit 18 and secured to non-contact electrode device 16. Cooling tube 38 may comprise any kind of suitable cooling medium, such as a cooled metal rod, or a hollow cylindrical jacket with coolant flowing therethrough, or a cylindrical heat exchanger, or even a Peltier effect electrothermocooler.

An example of a flowable material which can be electroheated with apparatus 10 is liquid egg. The liquid egg is introduced through tube 12 and is rapidly electroheated as it passes through conduit 18. The egg becomes a coagulated rod as a result of the electroheating in conduit 18. The coagulated rod continues on to cooling tube 38 and its outer surface is cooled thereat. The coagulated rod may now be cut to size and conveyed further past cooling tube 38, such as by means of flowing cold water (not shown).

It will be appreciated by persons skilled in the art that the present invention is not limited to what has been particularly shown and described hereinabove. Rather, the scope of the present invention is defined only by the claims that follow:

What is claimed is:

1. Electroheating apparatus comprising:

a conduit;

a cone-shaped electrode circumferentially surrounding said conduit;

an electrical power source connected to said electrode;

an electrically non-conductive endcap connected to said conduit and electrode, said conduit, electrode and endcap defining a chamber therebetween; and an electrolytic solution disposed in said chamber.

2. Apparatus according to claim 1 wherein said conduit is constructed of a porous, electrically non-conductive material which is wetted by said electrolytic solution.

3. Apparatus according to claim 1 and further comprising a tube adapted for flow therethrough of a flowable material, said tube being in fluid communication with said conduit.

4. Apparatus according to claim 3 wherein said tube is constructed of an electrically non-conductive material.

5. Apparatus according to claim 1 and further comprising a flowable material flowing through said conduit, wherein electrical current passes from said electrode through said electrolytic solution to said conduit to said flowable material, thereby electroheating said flowable material.

6. Apparatus according to claim 5 wherein said electrolytic solution is chosen to have an electrical conductivity such that there is generally an equal distribution of electrical current through said flowable material along an entire length of said conduit.

7. Apparatus according to claim 1 and further comprising an inlet pipe and an exit pipe for flow therethrough of said electrolytic solution into and from said chamber.

8. Apparatus according to claim 1 and further comprising a cooling tube positioned downstream of said conduit and in fluid communication therewith.

9. A method for electroheating a flowable material, comprising:

providing electroheating apparatus comprising:

a conduit;

a cone-shaped electrode circumferentially surrounding said conduit;

an electrical power source connected to said electrode;

an electrically non-conductive endcap connected to said conduit and electrode, said conduit, electrode and endcap defining a chamber therebetween; and an electrolytic solution disposed in said chamber;

causing a flowable material to flow through said conduit; and passing an electrical current from said electrode through said electrolytic solution to said conduit to said flowable material, thereby electroheating said flowable material.

* * * * *